US006786705B2

(12) United States Patent
Kurita et al.

(10) Patent No.: US 6,786,705 B2
(45) Date of Patent: Sep. 7, 2004

(54) VARIABLE DISPLACEMENT COMPRESSOR

(75) Inventors: Hajime Kurita, Kariya (JP); Hiroshi Uneyama, Kariya (JP); Tetsuhiko Fukanuma, Kariya (JP); Hiroaki Kayukawa, Kariya (JP); Takahiro Moroi, Kariya (JP); Tatsuya Koide, Kariya (JP); Kenji Mochizuki, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 65 days.

(21) Appl. No.: 10/329,121

(22) Filed: Dec. 24, 2002

(65) Prior Publication Data

US 2003/0131725 A1 Jul. 17, 2003

(30) Foreign Application Priority Data

Dec. 25, 2001 (JP) ..... 2001-392483
Aug. 9, 2002 (JP) ..... 2002-234022

(51) Int. Cl.[7] ..... F04B 49/16

(52) U.S. Cl. ..... 417/274; 417/222.2; 92/12.2; 92/13

(58) Field of Search ..... 417/222.2, 274, 417/269; 92/71, 12.2, 13

(56) References Cited

U.S. PATENT DOCUMENTS 2,956,501 A * 10/1960 Norlin ..... 417/270
4,886,423 A * 12/1989 Iwanami et al. ..... 417/222.2
5,242,274 A * 9/1993 Inoue ..... 417/222.2
5,540,559 A 7/1996 Kimura et al. ..... 417/222.2
5,647,730 A * 7/1997 Woollatt ..... 417/274
5,785,503 A 7/1998 Ota et al. ..... 417/269
6,244,159 B1 * 6/2001 Kimura et al. ..... 92/12.2
6,443,707 B1 * 9/2002 Kimura et al. ..... 417/222.2
2001/0031205 A1 * 10/2001 Ota et al. ..... 417/222.1

FOREIGN PATENT DOCUMENTS

EP 1 323 923 A2 * 12/2002
JP 62-74179 5/1987 ..... F04B/27/08
JP 06-288347 10/1994 ..... F04B/27/08
JP 08-334084 12/1996 ..... F04B/27/08

* cited by examiner

*Primary Examiner*—Justine R. Yu
*Assistant Examiner*—Emmanuel Sayoc
(74) *Attorney, Agent, or Firm*—Morgan & Finnegan, LLP

(57) ABSTRACT

A variable displacement compressor has a drive shaft, a rotor supported by the drive shaft, a drive plate supported by the drive shaft and a hinge mechanism located between the rotor and the drive plate. The hinge mechanism includes a cam, which is located on the rotor, and a guide portion, which is located on the drive plate. The cam has a cam surface, which has a predetermined profile. One of the cam surface and the guide portion slides against the other in accordance with inclination of the drive plate. The guide portion traces a path corresponding to the profile of the cam surface with respect to the cam. The path includes a first path corresponding to a small displacement region of the compressor and a second path corresponding to a large displacement region of the compressor. The profile of the cam surface is determined such that the first path and the second path bulge in a direction opposite to each other to compensate for fluctuation of a top dead center position of the piston.

18 Claims, 7 Drawing Sheets

Fig.8(a)
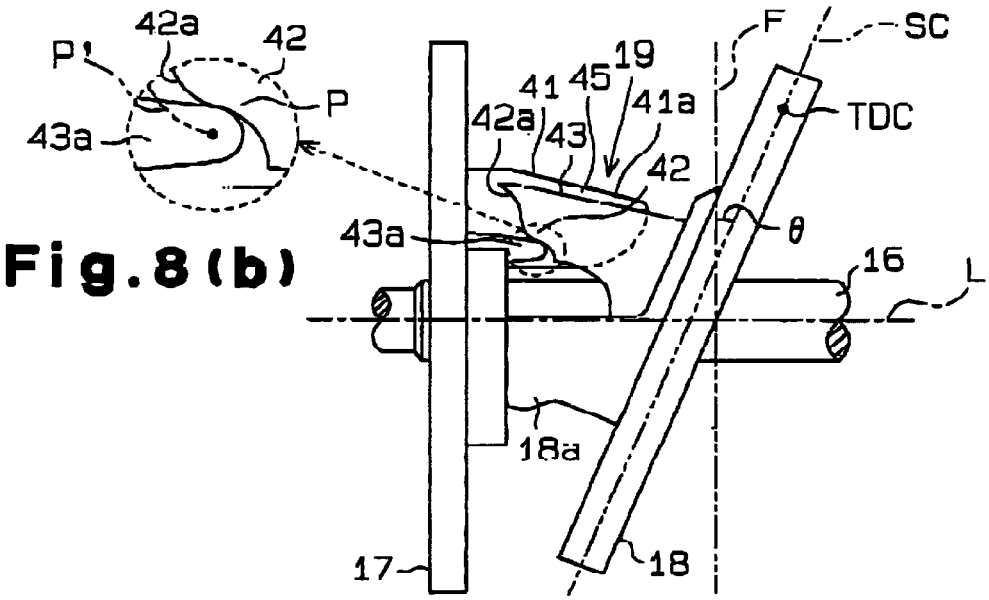
Fig.8(b)
Fig.9
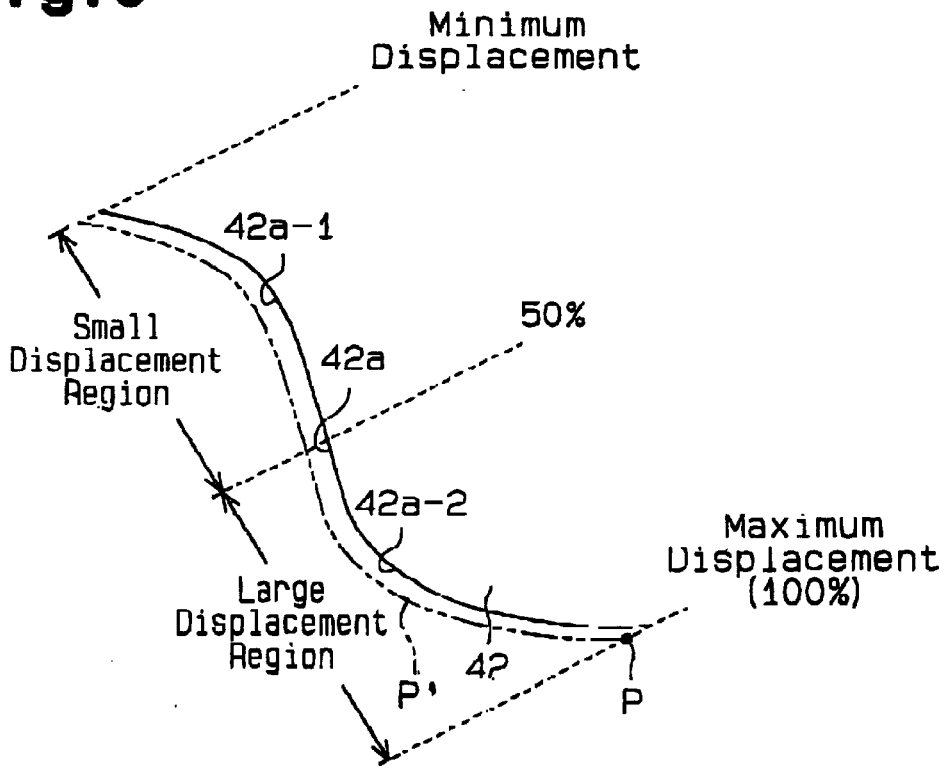

VARIABLE DISPLACEMENT COMPRESSOR

BACKGROUND OF THE INVENTION

The present invention relates to a variable displacement compressor used in a vehicular air conditioner.

Japanese Laid-Open Patent Publication No. 6-288347 discloses such a variable displacement compressor.

As shown in FIG. 12, the compressor of the publication includes a housing 101, in which a crank chamber 102 is defined. A drive shaft 103 is rotatably arranged in the crank chamber 102. A rotor 104 is coupled to the drive shaft 103 and is located in the crank chamber 102. The rotor 104 rotates integrally with the drive shaft 103. A drive plate, which is a swash plate 105 in this embodiment, is accommodated in the crank chamber 102. A spherical sleeve 106 is slidably supported by the drive shaft 103. The swash plate 105 is tiltably supported by the spherical sleeve 106.

Cylinder bores 101*a* are defined in the housing 101. Each cylinder bore 101*a* accommodates a piston 107. Each piston 107 is coupled to the swash plate 105 with a couple of shoes 108. A valve plate assembly 109 is provided in the housing 101. In each cylinder bore 101*a*, a compression chamber 110 is defined by the associated piston 107 and the valve plate assembly 109.

A hinge mechanism 111 is located between the rotor 104 and the swash plate 105. The swash plate 105 is coupled to the rotor 104 with the hinge mechanism 111 and is supported by the drive shaft 103 with the spherical sleeve 106. This permits the swash plate 105 to rotate integrally with the rotor 104 and the drive shaft 103, and to slide along the axis L of the drive shaft 103. While sliding, the swash plate 105 inclines relative to the drive shaft 103 about the spherical sleeve 106.

As the pressure in the crank chamber 102 varies, the difference between the pressure in the crank chamber 102 and the pressure in the compression chambers 110 is changed. Accordingly, the inclination angle of the swash plate 105 is changed. As a result, the stroke of each piston 107, or the compressor displacement, is varied.

The hinge mechanism 111 includes support arms 112 projecting from the rotor 104 and guide pins 113 projecting from the swash plate 105. A guide hole 114 is formed in each support arm 112, and a spherical portion 113*a* is formed at the distal end of each guide pin 113. The spherical portion 113*a* of each guide pin 113 is fitted in the guide hole 114 of the corresponding support arm 112 and slides with respect to the guide hole 114. Each guide hole 114 is parallel to an imaginary surface defined by the axis L of the drive shaft 103 and the top dead center corresponding position of the swash plate 105 (or the center of an imaginary sphere formed by the shoes 108 of the piston 107 located at the top dead center position). Each guide hole 114 is also formed straight toward the axis L of the drive shaft 103.

Therefore, when the inclination angle of the swash plate 105 increases, the spherical portion 113*a* of each guide pin 113 is rotated clockwise as viewed in the drawing about an axis P, which extend through the center of the spherical portion 113*a* and is perpendicular to the imaginary surface, inside the corresponding guide hole 114. The spherical portion 113*a* of each guide pin 113 linearly slides along an inner surface (cam surface) 114*a* of the guide hole 114 in a direction to separate from the drive shaft 103. When the inclination angle of the swash plate 105 decreases, the spherical portion 113*a* of each guide pin 113 is rotated counterclockwise as viewed in the drawing about the axis P inside the guide hole 114. The spherical portion 113*a* of each guide pin 113 linearly slides along the cam surfaces 114*a* of the guide hole 114 in a direction to approach the drive shaft 103.

That is, the profile of each cam surface 114*a* is designed such that a path P' of the rotary axis P of the corresponding spherical portion 113*a* is straight.

The graph of FIG. 6 shows the result of an examination on the variable displacement compressor of the above publication performed by the present inventor. As shown by a chain double-dashed line, which is a characteristic line, the present inventor discovered that according to the hinge mechanism 111, or the profile of the cam surface 114*a*, of the above publication, the top dead center position of each piston 107 fluctuates by a large amount when the displacement is varied.

If the top dead center position of each piston 107 fluctuates, the clearance (top clearance) TC between the piston 107 and the valve plate assembly 109 varies. Therefore, if, for example, the top clearance TC increases by the variation of the displacement, the dead volume of each compression chamber 110 increases. Accordingly, the expansion amount of refrigerant gas increases, which decreases the volumetric efficiency of the variable displacement compressor.

SUMMARY OF THE INVENTION

Accordingly, it is an objective of the present invention to provide a variable displacement compressor that includes a hinge mechanism that suppresses fluctuation of a top clearance although the displacement is varied.

To achieve the above objective, the present invention provides a variable displacement compressor, which includes a housing, a single-headed piston, a drive shaft, a rotor, a drive plate, and a hinge mechanism. The housing includes a cylinder bore. The single-headed piston is accommodated in the cylinder bore. The drive shaft is rotatably supported by the housing. The rotor is supported by the drive shaft and rotates integrally with the drive shaft. The drive plate is supported by the drive shaft and slides along and inclines with respect to the drive shaft. The hinge mechanism is located between the rotor and the drive plate. Rotation of the drive shaft is converted into reciprocation of the piston via the rotor, the hinge mechanism, and the drive plate. The hinge mechanism guides the drive plate such that the drive plate slides along and inclines with respect to the drive shaft. The inclination angle of the drive plate determines the displacement of the compressor. The hinge mechanism includes a cam, which is locatedon one of the rotor and the drive plate, and a guide portion, which is located on the other one of the rotor and the drive plate. The cam has a cam surface, which has a predetermined profile. The guide portion abuts against the cam surface. One of the cam surface and the guide portion slides against the other in accordance with inclination of the drive plate. The guide portion traces a path corresponding to the profile of the cam surface with respect to the cam. The path includes a first path corresponding to a small displacement region of the compressor and a second path corresponding to a large displacement region of the compressor. The profile of the cam surface is determined such that the first path and the second path bulge in a direction opposite to each other to compensate for fluctuation of a top dead center position of the piston with respect to the housing.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which;

FIG. 1(*b*) is an enlarged view showing a circle of broken line in FIG. 1(*a*).

FIG. 3(*b*) is an enlarged view showing a circle of broken line in FIG. 3(*a*).

FIG. 8 is a side view illustrating the hinge mechanism according to another modified embodiment;

FIG. 9 is an enlarged view illustrating the cam surface of the hinge mechanism shown in FIG. 8;

DETAILED DESCRIPTION OF THE PREFERRED EMBODIMENTS

A variable displacement compressor according to one embodiment of the present invention will now be described. The compressor forms a part of a refrigeration cycle of a vehicular air-conditioner.

Figure 1:
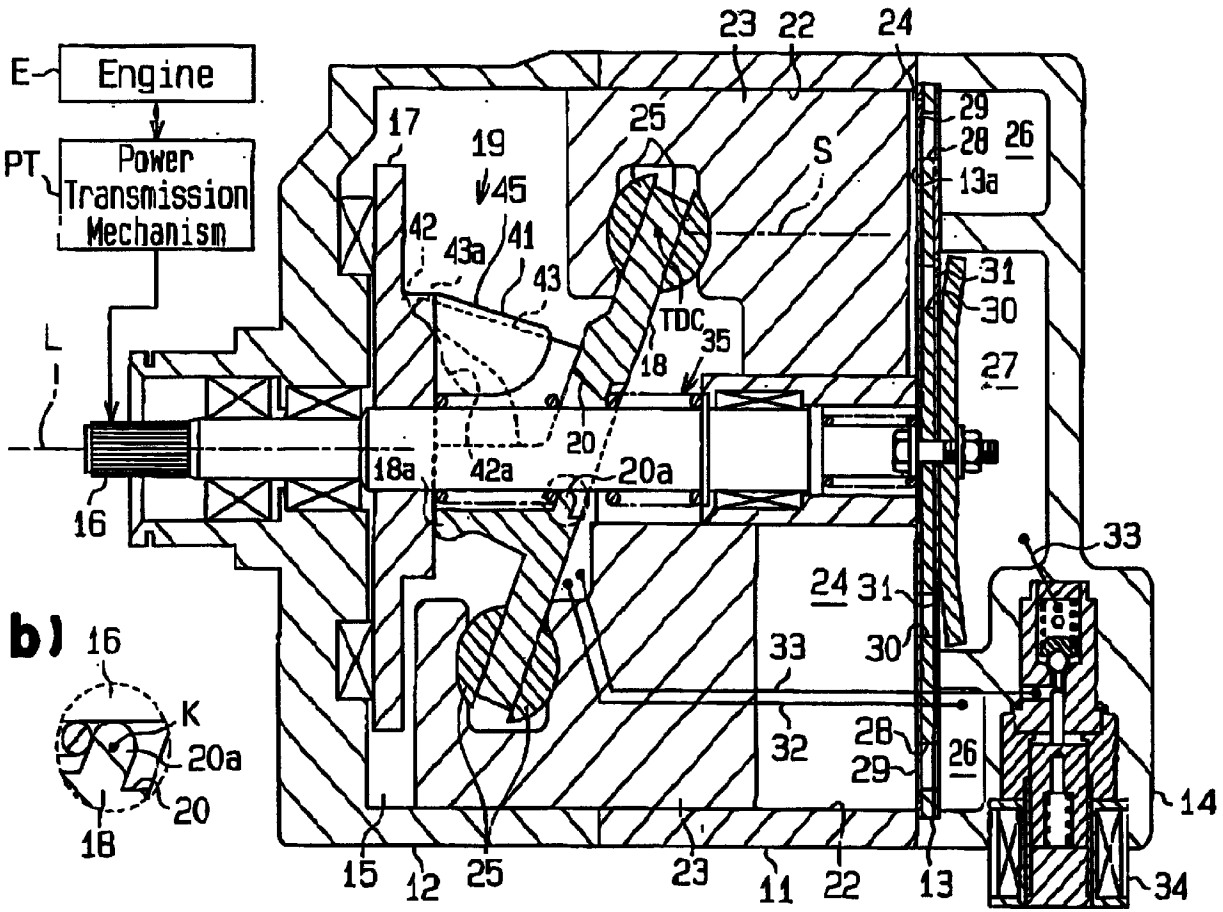
FIG. 1(*a*) is a cross-sectional view illustrating a variable displacement compressor of the preferred embodiment of the present invention.

As shown in FIG. 1(*a*), the compressor includes a cylinder block 11, a front housing member 12, a valve plate assembly 13, and a rear housing member 14. The front housing member 12 is secured to the front end of the cylinder block 11. The rear housing member 14 is secured to the rear end of the cylinder block 11 with the valve plate assembly 13 in between. The left end of the compressor in FIG. 1(*a*) is defined as the front of the compressor, and the right end is defined as the rear of the compressor.

The cylinder block 11 and the front housing member 12 define a crank chamber 15. The cylinder block 11 and the front housing member 12 define a crank chamber 15. A drive shaft 16 extends through the crank chamber 15 and is rotatable with respect to the cylinder block 11 and the front housing 12. The drive shaft 16 is coupled to the output shaft of a power source of the vehicle, which is an engine E in this embodiment, through a clutchless type power transmission mechanism PT, which constantly transmits power. Therefore, the drive shaft 16 is always rotated by the power supply from the engine E when the engine E is running.

A rotor 17 is coupled to the drive shaft 16 and is located in the crank chamber 15. The rotor 17 rotates integrally with the drive shaft 16. A drive plate, which is a swash plate 18 in the preferred embodiment, is housed in the crank chamber 15. A through hole 20 is formed at the center of the swash plate 18. The drive shaft 16 is inserted through the through hole 20. The swash plate 18 is slidably and tiltably supported by the drive shaft 16. A substantially semispherical support 20*a* is formed at the lower portion of the through hole 20. A hinge mechanism 19 is locate between the rotor 17 and the swash plate 18 on the side opposite to the support 20*a* with respect to the axis L of the drive shaft 16.

The hinge mechanism 19 and the support 20*a* permit the swash plate 18 to rotate integrally with the rotor 17 and the drive shaft 16. The swash plate 18 slides along the axis L of the drive shaft 16 and tilts with respect to the drive shaft 16 about the pivot axis, which is the axis K of the support 20*a*.

Cylinder bores 22 are formed in the cylinder block 11 about the axis L of the drive shaft 16 at equal angular intervals. A single headed piston 23 is accommodated in each cylinder bore 22. The piston 23 reciprocates inside the cylinder bore 22. The front and rear openings of each cylinder bore 22 are closed by the associated piston 23 and the valve plate assembly 13. A compression chamber 24 is defined in each cylinder bore 22. The volume of the compression chamber 24 changes according to the reciprocation of the corresponding piston 12. Each piston 23 is coupled to the peripheral portion of the swash plate 18 by a pair of shoes 25. The shoes 25 convert rotation of the swash plate 18, which rotates with the drive shaft 16, to reciprocation of the pistons 23.

A suction chamber 26 and a discharge chamber 27 are defined between the valve plate assembly 13 and the rear housing 14.

The valve plate assembly 13 has suction ports 28, suction valve flaps 29, discharge ports 30 and discharge valve flaps 31. Each set of the suction port 28, the suction valve flap 29, the discharge port 30 and the discharge valve flap 31 corresponds to one of the cylinder bores 22. As each piston 23 moves from the top dead center to the bottom dead center, refrigerant gas, which is carbon dioxide in this embodiment, in the suction chamber 26 is drawn into the corresponding compression chamber 24 through the corresponding suction port 28 while flexing the suction valve flap 29 to an open position. Refrigerant gas that is drawn into the compression chamber 24 is compressed to a predetermined pressure as the piston 23 is moved from the bottom dead center to the top dead center. Then, the gas is discharged to the discharge chamber 27 through the corresponding discharge port 30 while flexing the discharge valve flap 31 to an open position.

As shown in FIGS. 1(*a*) to 3, the hinge mechanism 19 is located in the vicinity of a top dead center corresponding position TDC of the swash plate 18, or the center of an imaginary sphere formed by the shoes 25 of the piston 23 located at the top dead center position. More specifically, a first engaging body, which is a projection 41 in the preferred embodiment, is integrally formed with the rear surface of the rotor 17 at a portion facing the top dead center corresponding position TDC. The projection 41 has a hollow structure and includes two branches 45 on the outermost side. This reduces the weight of the hinge mechanism 19 as compared to a case in which the projection 41 has a solid structure (this does not deviate from the scope of the present invention).

A cam 42 is integrally formed at the proximal portion of each branch 45 of the projection 41. A second engaging body, which includes left and right arms 43 in the preferred embodiment, is integrally formed on the front surface of the swash plate 18. The cams 42 and the arms 43 are located symmetrically with respect to the top dead center corresponding position TDC of the swash plate 18 in the rotational direction of the rotor 17.

The two arms 43 are arranged on opposite sides of the projection 41. Outer surfaces 41*a* of the projection 41 are engaged with side surfaces 43*b* of the arms 43. Thus, power is transmitted from the projection 41 to the arms 43. A concave guide portion 43*a* is formed on the distal end of each arm 43. Each guide portion 43*a* abuts against a cam surface 42*a*, which is formed on the rear surface of each cam 42.

The hinge mechanism 19 of the compressor according to the preferred embodiment is formed symmetrical with respect to the top dead center corresponding position TDC in the rotational direction of the drive shaft 16 such that the hinge mechanism 19 is used in a suitable manner regardless of the rotational direction of the engine, or the drive shaft 16, of the vehicle to which the compressor is mounted to expand the versatility. That is, the compressor of the preferred embodiment is compatible with an engine having either rotational direction.

As shown in FIG. 1(*a*), a bleed passage 32, a supply passage 33, and a control valve 34 are formed in the housing. The bleed passage 32 connects the crank chamber 15 to the suction chamber 26. The supply passage 33 connects the discharge chamber 27 to the crank chamber 15. The control valve 34, which is an electromagnetic valve in this embodiment, is located in the supply passage 33.

The opening degree of the control valve 34 is adjusted to control the balance between the flow rate of highly pressurized gas supplied to the crank chamber 15 through the supply passage 33 and the flow rate of gas conducted out of the crank chamber 15 through the bleed passage 32. The pressure in the crank chamber 15 is thus adjusted. As the pressure in the crank chamber 15 varies, the difference between the pressure in the crank chamber 15 and the pressure in the compression chamber 24 is changed, which in turn varies the inclination angle θ the swash plate 18. Accordingly, the stroke of each piston 23, or the compressor displacement, is varied.

Figures 3A, 3B:
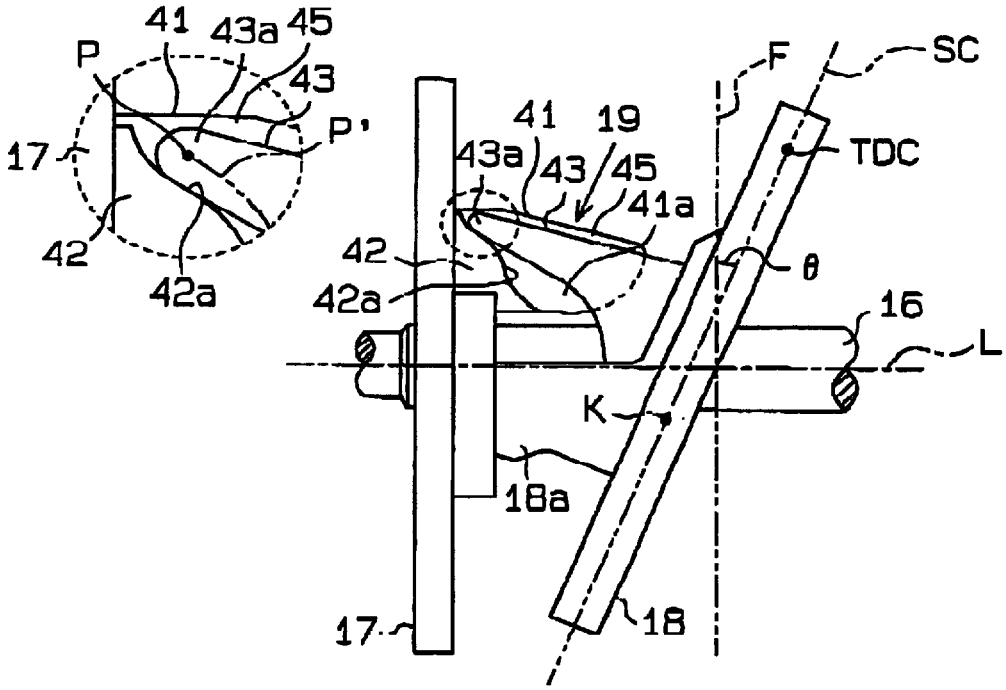
FIG. 3(*a*) is a side view illustrating the hinge mechanism.

As shown in FIG. 3(*a*), the inclination θ of the swash plate 18 represents the angle between a flat imaginary surface (swash plate center surface) SC, which is parallel to the swash plate 18 and lies on the top dead center corresponding position TDC, and a flat surface F, which is perpendicular to the axis L of the drive shaft 16.

As shown in FIG. 1(*a*), if, for example, the opening degree of the control valve 34 decreases, the pressure in the crank chamber 15 is decreased. When the pressure in the crank chamber 15 decreases, the inclination angle 0 of the swash plate 18 is increased. Therefore, the stroke of each piston 23 is increased, which increases the displacement of the compressor. When a stopper 18*a*, which is located on the front surface of the swash plate 18, abuts against the rear surface of the rotor 17, the swash plate 18 is at the maximum inclination angle.

On the contrary, when the opening degree of the control valve 34 increases, the pressure in the crank chamber 15 is increased. When the pressure in the crank chamber 15 increases, the inclination angle θ of the swash plate 18 is decreased. Therefore the stroke of each piston 23 decreases, which decreases the displacement of the compressor. The minimum inclination angle of the swash plate 18 is not zero and is determined by a limit member (spring) 35 arranged on the drive shaft 16.

As shown in FIGS. 3(*a*) and 3(*b*), when the inclination angle θ of the swash plate 18 increases, the guide portion 43*a* of each arm 43 is rotated clockwise as viewed in the drawings about the rotary axis P and moves in a direction to separate from the drive shaft 16 along the cam surface 42*a* of the corresponding cam 42. On the contrary, when the inclination angle θ of the swash plate 18 decreases, the guide portion 43*a* of each arm 43 is rotated counterclockwise as viewed in the drawings about the rotary axis P and slides in a direction to approach the drive shaft 16 along the cam surface 42*a* of the corresponding cam 42. Therefore, the rotary axis P of each guide portion 43*a* defines a path P' along the profile of the corresponding clam surface 42*a* in accordance with the variation of the inclination angle θ of the swash plate 18.

Figure 5:
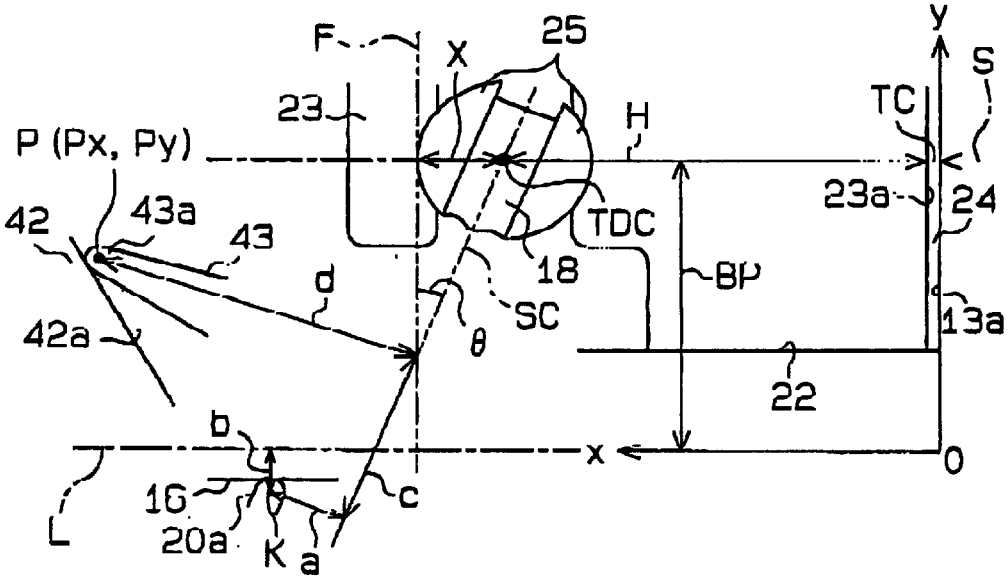
FIG. 5 is a schematic view explaining the suitable profile of the cam surface.
Figure 6:
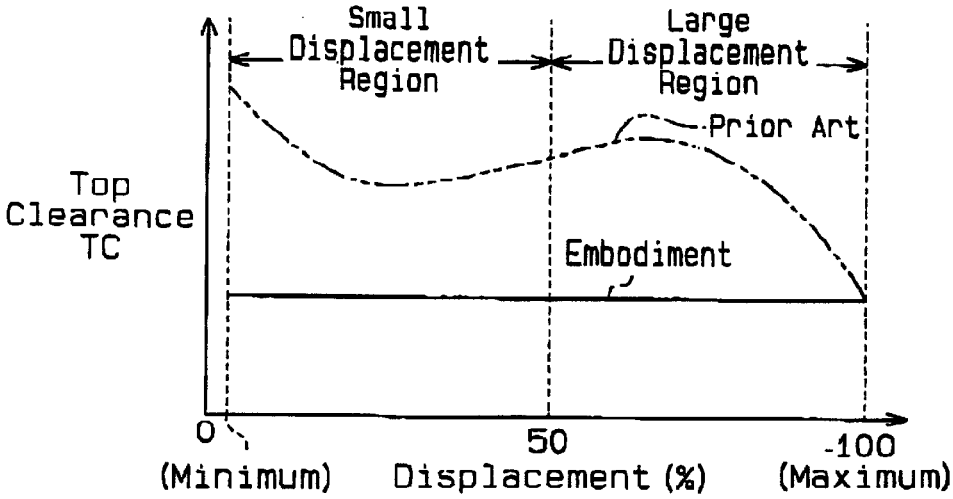
FIG. 6 is a graph explaining the relationship between the displacement of a compressor and a top clearance.

As shown by a solid line, which is a characteristic line, in FIG. 6, the profile of the cam surface 42*a* of each cam 42 is designed such that although the inclination angle θ of the swash plate 18, or the displacement of the compressor, varies, the top dead center position of each piston 23 is kept constant. In this case, the clearance (top clearance) TC between the distal ends 23*a* (see FIG. 5) of each piston 23 at the top dead position and the front end 13*a* of the valve plate assembly 13 is kept constant (for example, 0.1 mm or less). The suitable profile of the cam surfaces 42*a* will be described below.

The conventional compressor according to Japanese Laid-Open Patent Publication No. 6-288347 will be described. According to the conventional compressor, the profile of each cam surface 114*a* is designed such that the path of the rotary axis P of the corresponding spherical portion 113*a* is straight. It has already been mentioned in the "BACKGROUND OF THE INVENTION" that according to this profile, the top clearance TC fluctuates by a large amount as shown by the double-dashed line, which is a characteristic line, in FIG. 6 when the displacement of the compressor varies. When the compressor is running with a small displacement region, which is in the range of the minimum displacement to 50% displacement, the characteristic line has a curvature projecting toward the side in which the top clearance TC decreases. When the compressor is running with a large displacement region, which is in the range of 50 to 100% displacement (maximum displacement), the characteristic line has a curvature projecting toward the side in which the top clearance TC increases.

Thus, as exaggerated in FIG. 1(*a*), 3(*a*), 3(*b*), and 4, the cam surface 42*a* of each cam 42 according to the preferred embodiment has a region 42*a*-1 along which the corresponding guide portion 43*a* slides when the compressor is in a small displacement region and a region 42*a* 2 along which the corresponding guide portion 43*a* slides when the compressor is in a large displacement region. The region 42*a* 1 is concave such that the path P' of the axis P of the guide portion 43*a* projects, or bulges opposite to the pistons 23 (leftward as viewed in the drawings), or toward the side in which the top clearance TC increases. The region 42*a*-2 is convex such that the path P' of the axis P of the guide portion 43*a* projects, or bulges toward the pistons 23 (rightward as viewed in the drawings), or toward the side in which the top clearance TC decreases.

The region 42*a* 1 having the concave curved surface and the region 42*a*-2 having the convex curved surface are smoothly connected to each other. Therefore, the cross section of each cam surface 42*a* is S-shaped.

The suitable profile of the cam surfaces 42*a* will now be described.

As shown in FIG. 5, the axis L of the drive shaft 16 is assumed to be the x-axis. A straight line that lies along the front end 13*a* of the valve plate assembly 13, which is perpendicular to the axis L of the drive shaft 16 and the axis S of the piston 23 at the top dead center position, is assumed to be the y-axis. Therefore, the coordinate (Px, Py) of the intersecting point between a plane that lies along the x-axis and the y-axis and the axis P of the guide portion 43*a* is expressed by the following equations.

$$Px=d\times\cos\theta+X+H+TC \quad \text{(equation 1)}$$

$$Py=d\times\sin\theta+c\times\cos 0\cdot a\times\sin\theta+b$$

In the above equation, "a" is the distance between the axis K of the support 20*a* and the swash plate center surface SC. "b" is the y coordinate of the axis K of the support 20*a* (b<0 in this embodiment). "c" is the distance between a straight line, which is perpendicular to the swash plate center surface SC and the axis P of the guide portion 43*a*, and a straight line, which is perpendicular to the axis K of the support 20*a* and the swash plate center surface SC. "d" is the distance between the axis P of the guide portion 43*a* and the swash plate center surface SC, in other words, the distance between the intersecting line between the swash plate center surface SC and the plane F and the axis P of the guide portion 43*a*. "H" is the distance between the top dead center corresponding position TDC of the swash plate 18 and the distal end 23*a* of the piston 23. "BP" is the distance between the axis L of the drive shaft 16 and the axis S of the piston 23. "X" is the distance between the flat surface F and the top dead center corresponding position TDC.

In the preferred embodiment, the axis K of the support 20*a* is located on the swash plate center surface SC (that is, a-0). However, to apply universality to the coordinate (Px, Py), the axis K of the support 20*a* and the swash plate center surface SC are displaced in FIG. 5.

According to the law of similitude, "X" in the equation 1, can be expressed as follows.

$$x: c\times\sin\theta=(BP-b+a\times\sin\theta-c\times\cos\theta): c\times\cos\theta$$

$$X=(BP-b+a\times\sin\theta-c\times\cos\theta)\tan\theta \quad \text{(equation 2)}$$

Therefore, when the equation 2 is substituted into the equation 1, the x coordinate (Px) of the axis P of the guide portion 43*a* is as shown bellow.

$$Px=d\times\cos\theta+(BP-b+a\times\sin\theta-c\times\cos\theta 0)\tan 0|\Pi|\cdot TC$$

Therefore, for example, to keep the top clearance TC constant at 0.01 mm in all variable range of the displacement, the profile of each cam surface 42*a* should be designed such that the axis P of the corresponding guide portion 43*a* defines the path P' that passes through the coordinate (Px, Py), which is expressed as follows, when the inclination angle θ varies between the minimum and maximum inclination angle θ. That is, the cam surfaces 42*a* should be machined such that the cross-section of each cam surface 42*a* curves along the path P' of the axis P of the corresponding guide portion 43*a*.

$$(Px, Py)-(d\times\cos\theta+(BP-b+a\times\sin\theta-c\times\cos\theta)\tan\theta+H+0.01,\ d\times\sin\theta+c\times\cos\theta a\times\sin 0|b)$$

This embodiment provides the following advantages.

(1) The profile of each cam surface 42*a* of the hinge mechanism 19 is designed such that when the compressor is running in the small displacement region, the path P' of the axis P of the corresponding guide portion 43*a* projects toward the side in which the top clearance TC increases. The profile of each cam surface 42*a* of the hinge mechanism 19 is designed such that when the compressor is running in the large displacement region, the path P' of the axis P of the corresponding guide portion 43*a* projects toward the side in which the top clearance TC decreases. Therefore, the fluctuation of the top clearance TC is suppressed although the compressor displacement is varied. This prevents the volumetric efficiency of the compressor from decreasing.

(2) The region 42*a*-1 of each cam surface 42*a* of the hinge mechanism 19 is concave. The region 42*a*-2 of each cam surface 42*a* is convex. That is, the desired profile of each cam surface 42*a* is obtained by forming the surface corresponding to the path P' of the axis P of the corresponding guide portion 43*a*. This facilitates the machining of the cam surfaces 42*a*.

(3) The region 42*a* 2 of each cam surface 42*a* that corresponds to the large displacement region of the compressor is the convex curved surface. Therefore, the corresponding guide portion 43*a* needs to slide over the region 42*a*-2 having the convex curved surface to move from the position corresponding to the maximum displacement to the side that decreases the displacement. That is, the inclination angle 0 of the swash plate 18 that is located in the vicinity of the maximum inclination angle is not easily decreased as compared to a case in which the conventional cam surfaces 114*a* are applied. Thus, the inclination angle θ of the swash plate 18 is kept in the vicinity of the maximum inclination angle although the pressure in the crank chamber 15 increases due to, for example, the increase of the blowby gas from the compression chambers 24 in spite the control valve 34 is fully closed. Thus, the displacement of the compressor is reliably maintained in the vicinity of the maximum displacement when the control valve 34 is fully closed, and the compressor cools the passenger compartment in a suitable manner although the compressor is under a high temperature load.

(4) Each cam surface 42*a* of the hinge mechanism 19 has a profile that permits the top clearance TC to be constant although the inclination angle 0 of the swash plate 18 is varied. That is, the profile of each cam surface 42*a* is designed such that the axis P of the corresponding guide portion 43*a* defines the path P', which passes through the coordinate (Px, Py), which is expressed as follows, when the inclination angle 0 of the swash plate 18 is varied. Therefore, the volumetric efficiency of the compressor is further prevented from decreasing.

$$(Px, Py)=(d\times\cos 0|(BP-b+a\times\sin\theta-c\times\cos\theta)\tan\theta+H+TC,\ d\times\sin\theta+c\times\cos\theta-a\times\sin\theta+b)$$

(5) The inclination of the swash plate 18 is guided by portions different from portions that transmit power. This facilitates the designing of the cam surfaces 42*a* of the preferred embodiment where cam surfaces 42 are exposed. Thus, for example, as compared to the conventional hinge mechanism 111 that transmits power and guides the inclination of the swash plate 105 inside the guide holes 114 (see FIG. 12), the cam surfaces 42*a* are easily machined on the rotor 17 with high accuracy. That is, in the conventional compressor, the cam surfaces 114*a* must be machined by inserting a tool inside the guide holes 114, which is troublesome.

(6) Carbon dioxide is used as refrigerant. Thus, as compared to a case in which cholorfluorocarbon is used, the displacement of the compressor, or the stroke of each piston 23, is set very small. Therefore, on the assumption that the compression ratio is the same, although the fluctuation of the dead volume is the same as when chlorofluorocarbon is used, the influence to the volumetric efficiency is significantly fluctuation of the top clearance TC although the displacement is changed, is particularly effective in that the decrease of the volumetric efficiency is suppressed.

It should be apparent to those skilled in the art that the present invention may be embodied in many other specific forms without departing from the spirit or scope of the invention. Particularly, it should be understood that the invention may be embodied in the following forms.

Figure 7:
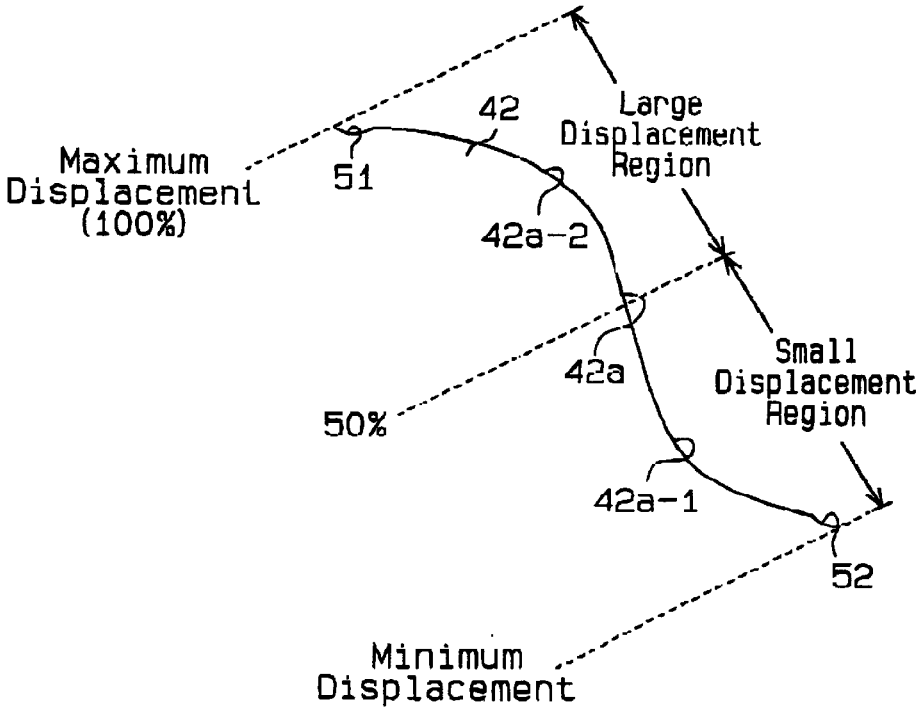
FIG. 7 is an enlarged view illustrating a cam surface of a hinge mechanism according to a modified embodiment.

As shown in FIG. 7, retaining recesses 51, 52 for retaining the guide portion 43*a* may be formed on each cam surface 42*a* at positions corresponding to the maximum displacement and the minimum displacement. The retaining recesses 51 formed corresponding to the maximum displacement permit further reliably retaining the inclination angle of the swash plate 18 at the maximum displacement. Thus, the advantage (3) of the preferred embodiment is further effectively provided.

When the clutchless type power transmission mechanism PT is applied as the above embodiment, power loss of the engine E is reduced by minimizing the compressor displacement when refrigeration is not needed. Since the retaining recess 52 is formed on each cam surface 42*a* in the vicinity of the position corresponding to the minimum displacement as shown in FIG. 7, the inclination angle of the swash plate 18 is reliably maintained in the vicinity of the minimum inclination corresponding to the fully opened state of the control valve 34 although the pressure in the crank chamber 15 is reduced for some reason. Thus, for example, the compressor displacement is reliably maintained in the vicinity of the minimum displacement when refrigeration is not needed. This reduces power loss of the engine E.

In the modified embodiment shown in FIG. 7, the retaining recesses 51 or 52 may be formed at the position corresponding to the maximum displacement only or the position corresponding to the minimum displacement only.

In the modified embodiment shown in FIG. 7, a retaining recess need not be formed at a position corresponding to the maximum displacement position or the minimum displacement position. That is, a retaining recess may be formed at a position corresponding to a middle displacement position (for example, 50% displacement). In this case, the swash plate 18 is reliably retained at the middle displacement position corresponding to the medium opening degree of the control valve 34 although a tilting moment caused by the centrifugal force is applied to the swash plate 18 when the engine E (drive shaft 16) is driven at high speed. The profile of each cam surface 42*a* may be designed such that the inclination angle of the swash plate 18 is changed step-by-step, or such that the guide portion 43*a* does not stop at portions other than the retaining recesses.

As shown in FIG. 8, the cam 42 may be formed on the distal end of each arm 43 and the cams 42 of the rotor 17 may be change to the guide portions 43*a*. Although not shown in the drawing, the projection 41 and the cams 42 may be located on the swash plate 18 and the arms 43 may be located on the rotor 17. That is, the cam surfaces 42*a* having the profile similar to the above embodiment are formed on the swash plate 18 instead of the rotor 17.

In this case, as exaggerated in FIGS. 8 and 9, each cam surface 42*a* is convex at the region 42*a*-1 where the guide portion 43*a* slides along when the compressor is running in the small displacement region such that the path P' of the axis P of the corresponding guide portion 43*a* projects toward the pistons 23 (rightward as viewed in the drawing). Each cam surface 42*a* is concave at the region 42*a*-2 where the guide portion 43*a* slides along when the compressor is running in the large displacement region such that the path P' of the axis P of the corresponding guide portion 43*a* projects toward the opposite side of the pistions 23 (leftward as viewed in the drawing).

Figure 2:
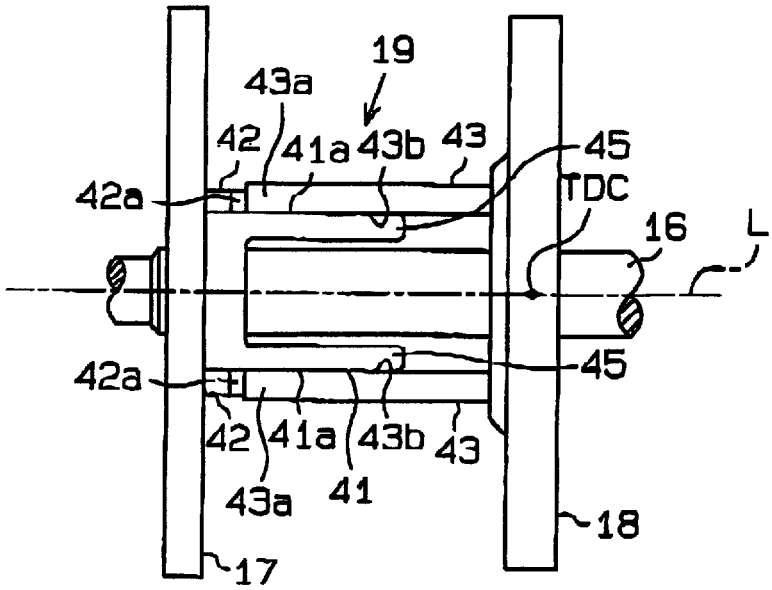
FIG. 2 is a plan view illustrating a hinge mechanism.

On the assumption that the rotational direction of the drive shaft 16 is represented by an arrow R (see FIG. 10), the arm 43 and the cam 43 located on the compression stroke side (leading side of the drive plate), which is the lower side of FIG. 2, mainly receive an axial load caused by the compression load applied to the swash plate 18. In the same manner, the arm 43 and the branch 45 located on the compression stroke side, which is the lower side of FIG. 2, transmit power from the rotor 17 to the swash plate 18. Therefore, one of the two arms 43 located on the lower side of FIG. 2 that transmits power and receives an axial load need to have more strength than the other arm 43 located at the upper side of FIG. 2. Also, one of the two branches 45 located at the lower side of FIG. 2 that transmits power needs to have more strength than the other branch 45 located at the upper side of FIG. 2.

Figure 10:
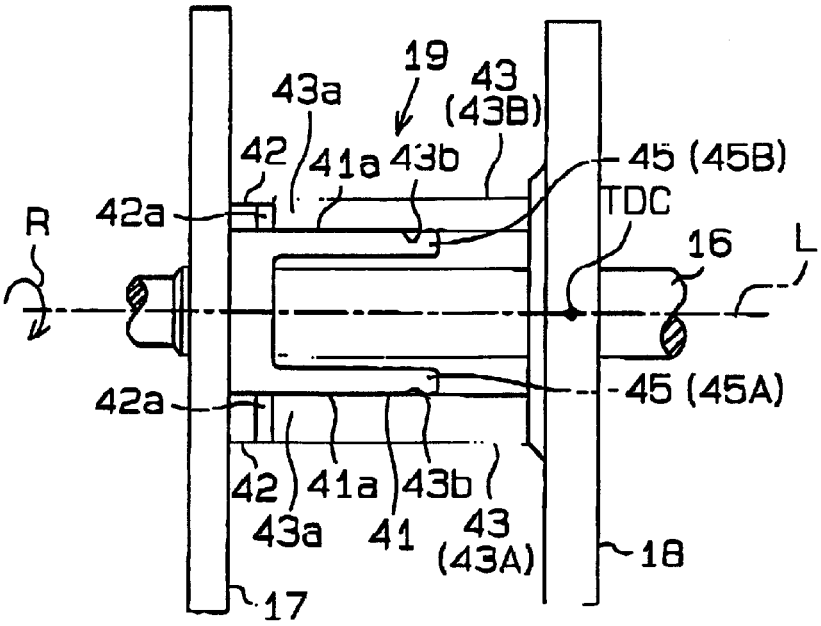
FIG. 10 is a plan view illustrating a hinge mechanism according to another modified embodiment.

Accordingly, the above embodiment may be modified as shown in FIG. 10. The hinge mechanism 19 of FIG. 10 has the projection 41, which includes branches 45A, 45B, which are formed on the rotor 17, and arms 43A, 43B, which are formed on the swash plate 18. In this case, the diameter of the branch 45A on the power transmission side (leading side of the rotor) is greater than the diameter of the other branch 45D to increase the strength. In other words, the cross-sectional area of the branch 45A is greater than the cross-sectional area of the equivalent position of the branch 45B in the longitudinal direction (left and right direction as viewed in FIG. 10). Also, the diameter of the arm 43A on the power transmission side and the axial load receiving side is greater than the diameter of the other arm 43B. In other words, the cross-sectional area of the arm 43A is greater than the cross-sectional area of the equivalent position of the other arm 43B in the longitudinal direction (left and right direction as viewed in FIG. 10).

As described above, thickening the arm 43A and the branch 45A on the power transmission side increases the strength of the arm 43A and the branch 45A than the other arm 43B and the branch 45B that are not on the power transmission side. Thus, as compared to a case in which both arms 43A, 43B and branches 45A, 45B are thickened, the weight of the hinge mechanism 19 is prevented from increasing and the endurance of the hinge mechanism 19 is guaranteed. The reduction in the weight of the hinge mechanism 19 facilitates designing the balance of the rotary parts of the compressor.

That is, the compressor of the above embodiment, which rotates in both directions, has high versatility. However, since the compressor does not limit the rotational direction of the drive shaft 16, the weight of the hinge mechanism 19 is not easily reduced. In contrast, when the rotational direction of the drive shaft 16 is limited, the versatility is reduced but the compressor can be designed to reduce the weight as shown in FIG. 10.

Figure 11:
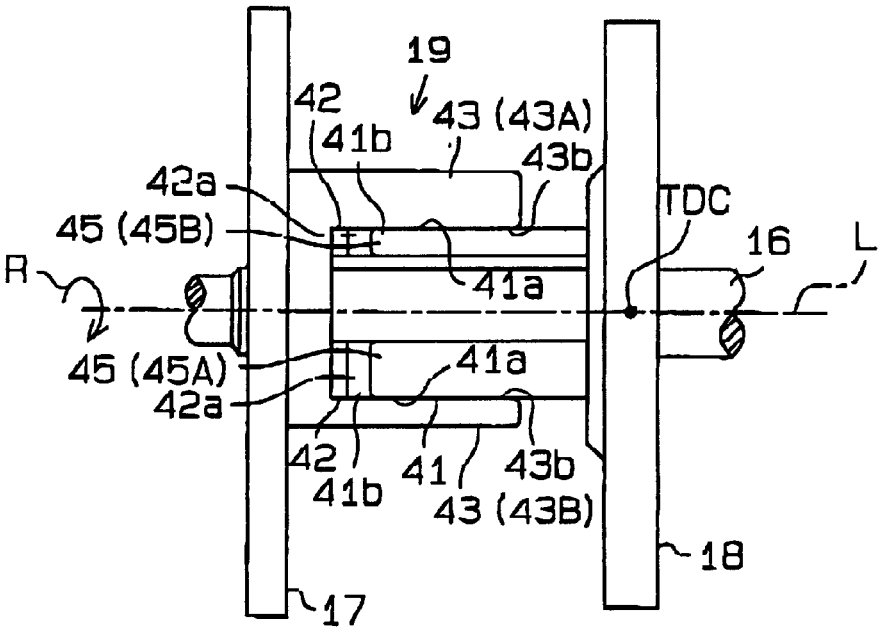
FIG. 11 is a plan view illustrating a hinge mechanism according to another modified embodiment.

The hinge mechanism 19 may be modified as shown in FIG. 11. In this case, the arms 43A, 43B are located on the rotor 17 and the projection 41 are located on the swash plate 18 such that the projection 41 is inserted between and engaged with the arms 43A, 43B to transmit power. The distal ends of the branches 45A, 45B, which form the projection 41, serve as guide portions 41*b* (having the similar structure as the guide portions 43*a*). The cam 42 is located at the proximal portion of each arm 43A, 43B at the rear surface of the rotor 17.

In the above structure, when the rotational direction of the drive shaft 16 is as shown by the arrow R, the arm 43A on the power transmission side (trailing side of the rotor) need to have more strength than the other arm 43B. Therefore, in the modified embodiment shown in FIG. 11, the diameter of the arm 43A on the power transmission side is greater than the diameter of the other arm 43B to increase the strength. In other words, the cross-sectional area of the arm 43A on the power transmission side is greater than the cross-sectional area of the equivalent position of the other arm 43B in the longitudinal direction. Thus, as compared to a case, in which both arms 43 are made thicker, the weight of the hinge mechanism 19 is prevented from increasing and the endurance is kept at the same level. As described above, the reduction of the weight of the hinge mechanism 19 facilitates designing the balance of the rotary parts of the compressor.

In the modified embodiment shown in FIG. 11, the branch 45A mainly receives an axial load caused by the compression load, and the branch 45B transmits power. However, when the load applied to each of the branches 45A, 45B are compared, the branch 45A that mainly receives the axial load needs to be stronger than the branch 45B that transmits power.

Therefore, in the modified embodiment shown in FIG. 11, the branch 45A that is on the axial load receiving side, or that is not on the power transmission side, is made thicker than the branch 45B to increase the strength. In other words, the cross-sectional area of the branch 45A is greater than the cross-sectional area of the equivalent position of the branch 45B in the longitudinal direction. Therefore, as compared to a case in which both branches 45A, 45B are made thicker, the weight is prevented from increasing and the endurance of the hinge mechanism 19 is maintained at the same level. As described above, the reduction of the weight of the hinge mechanism 19 facilitates designing the balance of the rotary parts of the compressor.

That is, the compressor of the above embodiment, which rotates in both directions, has high versatility. However, since the compressor does not limit the rotational direction of the drive shaft 16, the weight of the hinge mechanism 19 is not easily reduced. In contrast, when the rotational direction of the drive shaft 16 is limited, the versatility is reduced but the compressor can be designed to reduce the weight as shown in FIG. 11.

In the modified embodiments of FIGS. 10 and 11, the strength of the arm 43A and the branch 45A is increased by thickening the arm 43A and the branch 45A than the other arm 43B and the branch 45B. However, the arm 43A may be made of material that has higher strength than the other arm 43B and the branch 45A may be made of material that has higher strength than the branch 45B.

In the above embodiment, the projection 41 is branched into two branches 45 extending from one proximal portion projecting from the rotor 17. However, the branches 45 may project directly from the rotor 17.

In the above embodiment, each cam surface 42*a* has the region 42*a*-1, which is concave, and the region 42*a*-2, which is convex. However, the region 42*a*-1 may be a recess and the region 42*a*-2 may be a projection. This facilitates machining of the cam surfaces 42*a*.

Figure 4:
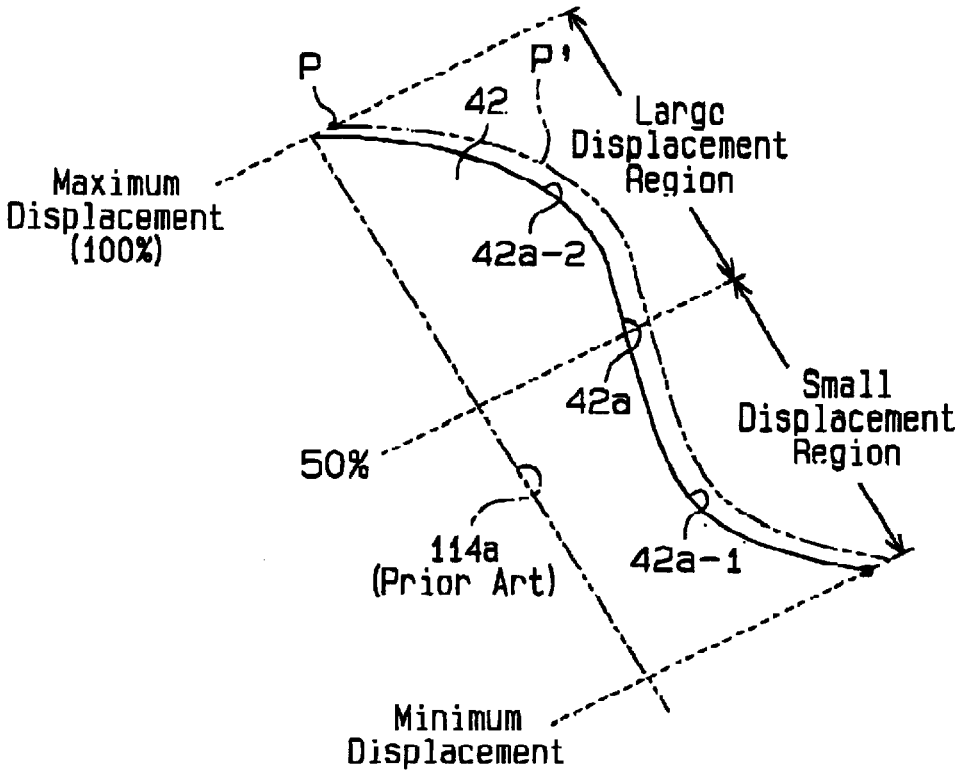
FIG. 4 is an enlarged view illustrating a cam surface of the hinge mechanism.

In the above embodiment, each of the regions 42*a*-1, 42*a*-2 of the cam surface 42*a* is the combination of curved surfaces having different curvature. However, each of the regions 42*a*-1 and 42*a*-2 may be formed by a curved surface with one curvature to be similar to the shape of FIG. 4. This facilitates machining of the cam surfaces 42*a*. In this case also, no substantial problem is caused concerning the fluctuation of the top clearance TC.

Figure 12:
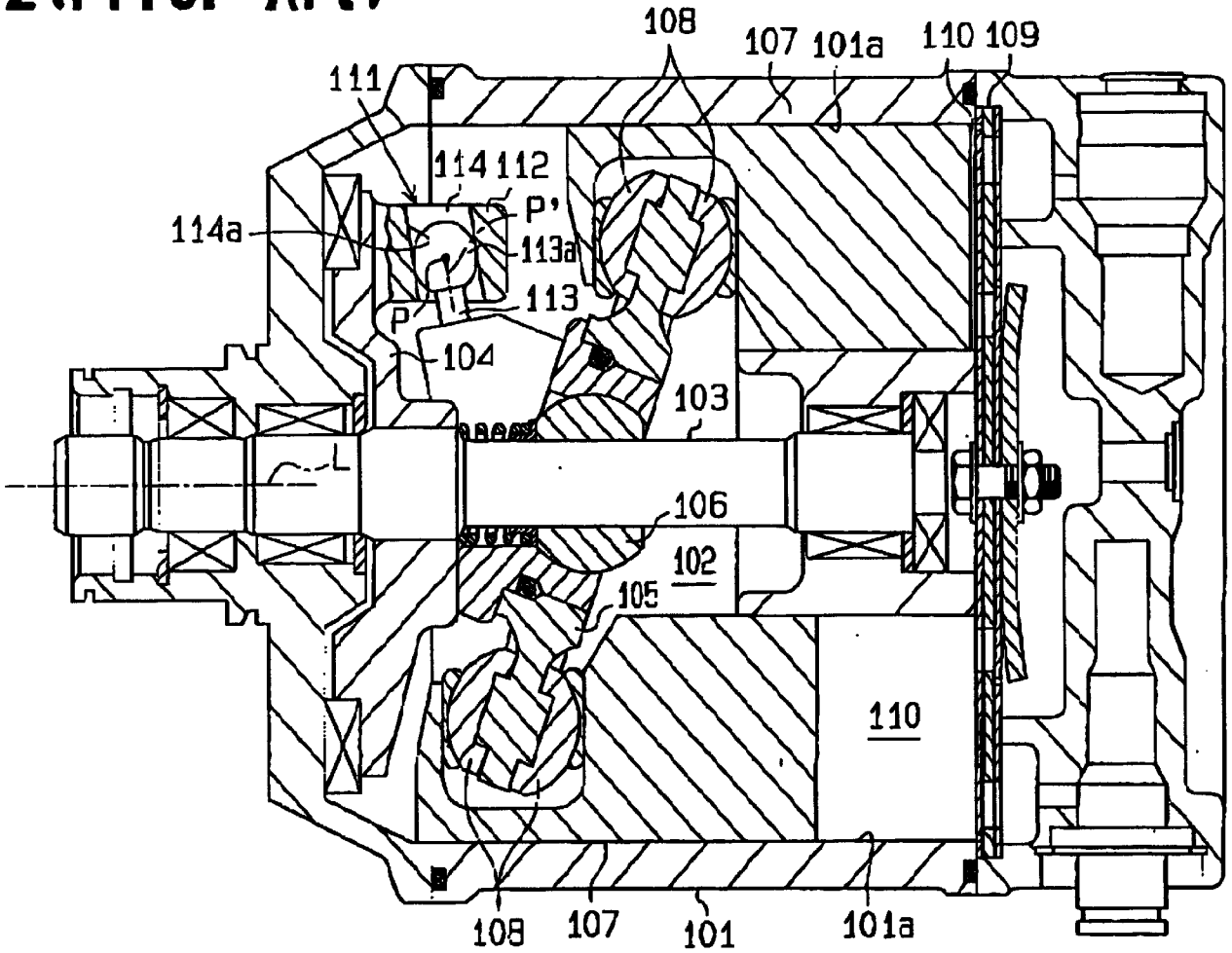
Fig.12(Prior Art)
FIG. 12 is a cross-sectional view illustrating a prior art variable displacement compressor.

The conventional hinge mechanism 19 may be applied in the above embodiment. In this case, as shown in FIG. 12, cams, which are the support arms 112, are located on the rotor 17 while the guide portions, which are the guide pins 113, are located on the swash plate 18, or the guide pins 113 are located on the rotor 17 while the support arms 112 are located on the swash plate 18. In either case, the cam surface 114*a* of the guide hole 114 of each support arm 112 have the profile that is the same as the cam surface 42*a* of the above embodiment.

The support 20*a* of the swash plate 18 may be eliminated and the swash plate 18 may be supported by the drive shaft 16 via the conventional spherical sleeve 106. In this case, the center of the spherical sleeve 106, or the pivot axis of the swash plates 18, is located on the axis L of the drive shaft 16 and the swash plate center surface SC. Therefore, in the description of the profile of the cam surface 42*a*, "a" and "b" are zero.

The present invention may be embodied in a wobble type variable displacement compressor.

Therefore, the present examples and embodiments are to be considered as illustrative and not restrictive and the invention is not to be limited to the details given herein, but may be modified within the scope and equivalence of the appended claims.

What is claimed is:

1. A variable displacement compressor comprising:

a housing, wherein the housing includes a cylinder bore;

a single-headed piston accommodated in the cylinder bore;

a drive shaft rotatably supported by the housing;

a rotor supported by the drive shaft, wherein the rotor rotates integrally with the drive shaft;

a drive plate supported by the drive shaft, wherein the drive plate slides along and inclines with respect to the drive shaft; and a hinge mechanism located between the rotor and the drive plate, wherein rotation of the drive shaft is converted into reciprocation of the piston via the rotor, the hinge mechanism, and the drive plate, wherein the hinge mechanism guides the drive plate such that the drive plate slides along and inclines with respect to the drive shaft, and wherein the inclination angle of the drive plate determines the displacement of the compressor, wherein the hinge mechanism includes a cam, which is located on one of the rotor and the drive plate, and a guide portion, which is located on the other one of the rotor and the drive plate, wherein the cam has a cam surface, which has a predetermined profile, and the guide portion abuts against the cam surface, wherein one of the cam surface and the guide portion slides against the other in accordance with inclination of the drive plate, and the guide portion traces a path corresponding to the profile of the cam surface with respect to the cam, and wherein the path includes a first path corresponding to a small displacement region of the compressor and a second path corresponding to a large displacement region of the compressor, wherein the profile of the cam surface is determined such that the first path and the second path bulge in a direction opposite to each other to compensate for fluctuation of a top dead center position of the piston with respect to the housing.

2. The compressor according to claim 1, wherein the cam surface includes a first cam surface section, against which the guide portion slides when the compressor displacement is at the small displacement region, and a second cam surface section, against which the guide portion slides when the compressor displacement is at the large displacement region, and wherein the first cam surface section is concave and the second cam surface section is convex.

3. The compressor according to claim 2, wherein the cross-section of the cam surface is substantially S-shaped.

4. The compressor according to claim 1, wherein the profile of the cam surface is determined such that the top dead center position of the piston with respect to the housing is substantially constant regardless of the inclination angle of the drive plate.

5. The compressor according to claim 4, wherein the cylinder bore has an opening, which is closed by a valve plate assembly, wherein the valve plate assembly has an end surface, which closes the opening of the cylinder bore, wherein, on a coordinate, in which an axis of the drive shaft is an x-axis, and a straight line that is perpendicular to the axis of the drive shaft and the axis of the piston located at the top dead center position and lies along the end surface of the valve plate assembly is y-axis, the distance between a pivot axis of the drive plate and the center surface of the drive plate =a, the y coordinate of the pivot axis of the drive plate =b, the distance between a lien that is perpendicular to the center surface of the drive plate and the axis of the guide portion and a line that is perpendicular to the pivot axis of the drive plate and the center surface of the drive plate =c, the distance between the axis of the guide portion and the center surface of the drive plate =d, the distance between a top dead center corresponding position of the drive plate and the distal end of the piston =H, the distance between the axis of the drive shaft and the axis of the piston is BP, and a top clearance between the distal end of the piston at the top dead center position and the valve plate assembly =TC, wherein the profile of the cam surface is determined corresponding to the variation of the inclination angle θ of the drive plate such that the axis of the guide portion traces a path that passes through a coordinate (x, y) expressed by an equation: $(x, y)=(d\times\cos\theta+)BP-b+a\times\sin\theta-c\times\cos 0)\tan 0+H+TC,\ d\times\sin\theta+c\times\cos\theta-a\times\sin\theta+b)$.

6. The compressor according to claim 1, wherein the cam surface has a retaining recess for retaining the guide portion when the drive plate is located in the vicinity of one of a predetermined maximum inclination angle and a predetermined minimum inclination angle.

7. The compressor according to claim 1, wherein the hinge mechanism includes a first engaging body, which extends from the rotor toward the drive plate, and a second engaging body, which extends from the drive plate toward the rotor, wherein the first and second engaging bodies are engaged with each other in the rotational direction of the drive shaft such that the drive plate rotates integrally with the rotor, and wherein the cam is located at the proximal portion of one of the first and second engaging bodies, and the guide portion is located at the distal end of the other one of the first and second engaging bodies.

8. The compressor according to claim 1, wherein the hinge mechanism includes a first engaging body, which extends from the rotor toward the drive plate, and a second engaging body, which extends from the drive plate toward the rotor, wherein the first and second engaging bodies are engaged with each other in the rotational direction of the drive shaft such that the drive plate rotates integrally with the rotor, and wherein the cam is located at the distal end of one of the first and second engaging bodies, and the guide portion is located at the proximal portion of the other one of the first and second engaging bodies.

9. The compressor according to claim 1, wherein the hinge mechanism includes at least two projections, which extend from the rotor toward the drive plate, and at least two arms, which extend from the drive plate toward the rotor, wherein the projections are located between the arms such that rotation of the rotor is transmitted to the drive plate, wherein one of the guide portion and the cam is located at the distal end of each arm, and the other one of the guide portion and the cam is located at the proximal portion of the projections, and wherein the strength of one of the projections located on the leading side of the rotor is greater than that of the other projection, and the strength of one of the arms located on the leading side of the drive plate is greater than that of the other arm.

10. The compressor according to claim 1, wherein the hinge mechanism includes at least two arms, which extend from the rotor toward the drive plate, and at least two projections, which extend from the drive plate toward the rotor, wherein the projections are located between the arms such that rotation of the rotor is transmitted to the drive plate, wherein one of the guide portion and the cam is located at the distal end of each projection, and the other one of the guide portion and the cam is located at the proximal portion of each arm, and wherein the strength of one of the arms located on the trailing side of the rotor is greater than that of the other arm, and the strength of one of the projections located on the leading side of the drive plate is greater than that of the other projection.

11. A variable displacement compressor comprising:

a housing, wherein the housing includes a cylinder bore;

a single-headed piston accommodated in the cylinder bore;

a drive shaft rotatably supported by the housing;

a rotor supported by the drive shaft, wherein the rotor rotates integrally with the drive shaft;

a drive plate supported by the drive shaft, wherein the drive plate slides along and inclines with respect to the drive shaft; and a hinge mechanism located between the rotor and the drive plate, wherein the rotation of the drive shaft is converted into reciprocation of the piston via the rotor, the hinge mechanism, and the drive plate, wherein the hinge mechanism guides the drive plate such that the drive plate slides along and inclines with respect to the drive shaft, and wherein the inclination angle of the drive plate determines the displacement of the compressor, wherein the hinge mechanism includes a cam, which is located on one of the rotor and the drive plate, and a guide portion, which is located on the other one of the rotor and the drive plate, wherein the cam has a cam surface, which has a predetermined profile, and the guide portion abuts against the cam surface, wherein one of the cam surface and the guide portion slides against the other corresponding to the inclination of the drive plate, and wherein the cam surface includes a first cam surface section, against which the guide portion slides when the compressor displacement is at a small displacement region, and a second cam surface section, against which the guide portion slides when the compressor displacement is at a large displacement region, and wherein the first cam surface section is concave and the second cam surface section is convex.

12. The compressor according to claim 11, wherein the cross section of the cam surface is substantially S-shaped.

13. The compressor according to claim 11, wherein the profile of the cam surface is determined such that the top dead center position of the piston with respect to the housing is substantially constant regardless of the inclination angle of the drive plate.

14. The compressor according to claim 11, wherein the cam surface has a retaining recess for retaining the guide portion when the drive plate is located in the vicinity of one of a predetermined maximum inclination angle and a predetermined minimum inclination angle.

15. The compressor according to claim 11, wherein the hinge mechanism, includes a first engaging body, which extends from the rotor toward the drive plate, and a second engaging body, which extends from the drive plate toward the rotor, wherein the first and second engaging bodies are engaged with each other in the rotational direction of the drive shaft such that the drive plate rotates integrally with the rotor, and wherein the cam is located at the proximal portion of one of the first and second engaging bodies, and the guide portion is located at the distal end of the other one of the first and second engaging bodies.

16. The compressor according to claim 11, wherein the hinge mechanism includes a first engaging body, which extends from the rotor toward the drive plate, and a second engaging body, which extends from the drive plate toward the rotor, wherein the first and second engaging bodies are engaged with each other in the rotational direction of the drive shaft such that the drive plate rotates integrally with the rotor, and wherein the cam is located at the distal end of one of the first and second engaging bodies, and the guide portion is located at the proximal portion of the other one of the first and second engaging bodies.

17. The compressor according to claim 11, wherein the hinge mechanism includes at least two projections, which extend from the rotor toward the drive plate, and at least two arms, which extend from the drive plate toward the rotor, wherein the projections are located between the arms such that rotation of the rotor is transmitted to the drive plate, wherein one of the guide portion and the cam is located at the distal end of each arm, and the other one of the guide portion and the cam is located at the proximal portion of the projections, and wherein the strength of one of the projections located on the leading side of the rotor is greater than that of the other projection, and the strength of one of the arms located on the leading side of the drive plate is greater than that of the other arm.

18. The compressor according to claim 11, wherein the hinge mechanism includes at least two arms, which extend from the rotor toward the drive plate, and a least two projections, which extend from the drive plate toward the rotor, wherein the projections are located between the arms such that rotation of the rotor is transmitted to the drive plate, wherein one of the guide portion and the cam is located at the distal end of each projection, and the other one of the guide portion and the cam is located at the proximal portion of each arm, and wherein the strength of one of the arms located on the trailing side of the rotor is greater than that of the other arm, and the strength of one of the projections located on the leading side of the drive plate is greater than that of the other projection.

* * * * *

UNITED STATES PATENT AND TRADEMARK OFFICE

CERTIFICATE OF CORRECTION

PATENT NO. : 6,786,705 B2
DATED : September 7, 2004
INVENTOR(S) : Hajime Kurita et al.

It is certified that error appears in the above-identified patent and that said Letters Patent is hereby corrected as shown below:

Title page, Item [54] and Column 1, line 1,
Title, should read -- A VARIABLE DISPLACEMENT COMPRESSOR WITH AT LEAST ONE PROJECTION FROM THE SWASH-PLATE THAT FOLLOWS AN CAM SURFACE FOR MAINTAINING THE TOP CLEARANCE SUBSTANTIALLY CONSTANT --

Column 7,
Line 10, please delete and insert therefore

-- $Py=d \times \sin\theta + c \times \cos\theta - a \times \sin\theta + b$ --

Line 45, please delete and insert therefore

-- $Px=d \times \cos\theta + (BP - b + a \times \sin\theta - c \times \cos\theta) \tan\theta + H + TC$ --

Lines 58-59, please delete and insert therefore

-- $(Px, Py)=(d \times \cos\theta + (BP - b + a \times \sin\theta - c \times \cos\theta) \tan\theta + H + 0.01,\ d \times \sin\theta + c \times \cos\theta - a \times \sin\theta + b)$ --

Column 8,
Lines 46-47, please delete and insert therefore $(Px, Py) = (d \times \cos\theta + (BP - b + a \times \sin\theta - c \times \cos\theta) \tan\theta + H + TC,\ d \times \sin\theta + c \times \cos\theta - a \times \sin\theta + b)$ Column 10,
Line 6, please delete "cam 43" and insert therefore -- cam 42 --
Line 26, please delete "45D" and insert therefore -- 45B --

Signed and Sealed this

Eighth Day of March, 2005

JON W. DUDAS
*Director of the United States Patent and Trademark Office*

UNITED STATES PATENT AND TRADEMARK OFFICE

CERTIFICATE OF CORRECTION

PATENT NO. : 6,786,705 B2
DATED : September 7, 2004
INVENTOR(S) : Hajime Kurita et al.

It is certified that error appears in the above-identified patent and that said Letters Patent is hereby corrected as shown below:

Title page, Item [54] and Column 1, line 1,
Title, should read -- A VARIABLE DISPLACEMENT COMPRESSOR WITH AT LEAST ONE PROJECTION FROM THE SWASH-PLATE THAT FOLLOWS A CAM SURFACE FOR MAINTAINING THE TOP CLEARANCE SUBSTANTIALLY CONSTANT --

Column 7,
Line 10, please delete and insert therefore

-- $Py=d \times \sin\theta + c \times \cos\theta - a \times \sin\theta + b$ --

Line 45, please delete and insert therefore

-- $Px=d \times \cos\theta + (BP - b + a \times \sin\theta - c \times \cos\theta) \tan\theta + H + TC$ --

Lines 58-59, please delete and insert therefore

-- $(Px, Py)=(d \times \cos\theta + (BP - b + a \times \sin\theta - c \times \cos\theta) \tan\theta + H + 0.01,\ d \times \sin\theta + c \times \cos\theta - a \times \sin\theta + b)$ --

Column 8,
Lines 46-47, please delete and insert therefore $(Px, Py) = (d \times \cos\theta + (BP - b + a \times \sin\theta - c \times \cos\theta) \tan\theta + H + TC,\ d \times \sin\theta + c \times \cos\theta - a \times \sin\theta + b)$ Column 10,
Line 6, please delete "cam 43" and insert therefore -- cam 42 --
Line 26, please delete "45D" and insert therefore -- 45B --

This certificate supersedes Certificate of Correction issued March 8, 2005.

Signed and Sealed this

Twenty-fourth Day of March, 2005

JON W. DUDAS
*Director of the United States Patent and Trademark Office*